United States Patent [19]

Komarov et al.

[11] 4,136,717

[45] Jan. 30, 1979

[54] TRAVELLING-WAVE LOOM WITH LOOM-STOPPING MECHANISM

[75] Inventors: Jury I. Komarov; Viktor M. Lukhmanov; Evgeny P. Kudryavtsev; Dmitry V. Titov; Gennady I. Kovalev, all of Moscow, U.S.S.R.

[73] Assignee: Vsesojuzny Nauchno-Issledovatelsky Institut Legkogo I Textilnogo Mashinostroenia, U.S.S.R.

[21] Appl. No.: 679,233

[22] Filed: Apr. 22, 1976

[30] Foreign Application Priority Data

Apr. 23, 1975 [SU] U.S.S.R. ..... 2129655

[51] Int. Cl.[2] ..... D03D 47/26

[52] U.S. Cl. ..... 139/436; 139/344

[58] Field of Search ..... 139/436, 188, 190, 191, 139/370.2, 344

[56] References Cited

U.S. PATENT DOCUMENTS 3,863,680 2/1975 Titou et al. ..... 139/436

3,880,197 4/1975 Bucil et al. ..... 139/436

3,900,049 8/1975 Zabotin et al. ..... 139/436

FOREIGN PATENT DOCUMENTS 208558 7/1966 U.S.S.R. ..... 139/436

*Primary Examiner*—Henry Jaudon

*Attorney, Agent, or Firm*—Steinberg & Blake

[57] ABSTRACT

A mechanism of a travelling-wave loom comprises a rotary reed and a separating grate composed of pivoted and stationary portions forming a channel for the weft thread carriers to be partially accommodated therein. Each of the portions is formed by plates, the pivoted portion having a plurality of strips swivelled to the stationary portion. Attached to each strip are plates of the pivoted portion. Near the strips there are installed devices adapted to cooperate therewith and to accomplish coupling thereof with the stop motion of the loom. This makes it possible to minimize the probability of damage to the plates of the separating grate and to improve the reliability of operation of the loom.

5 Claims, 5 Drawing Figures

FIG. 1
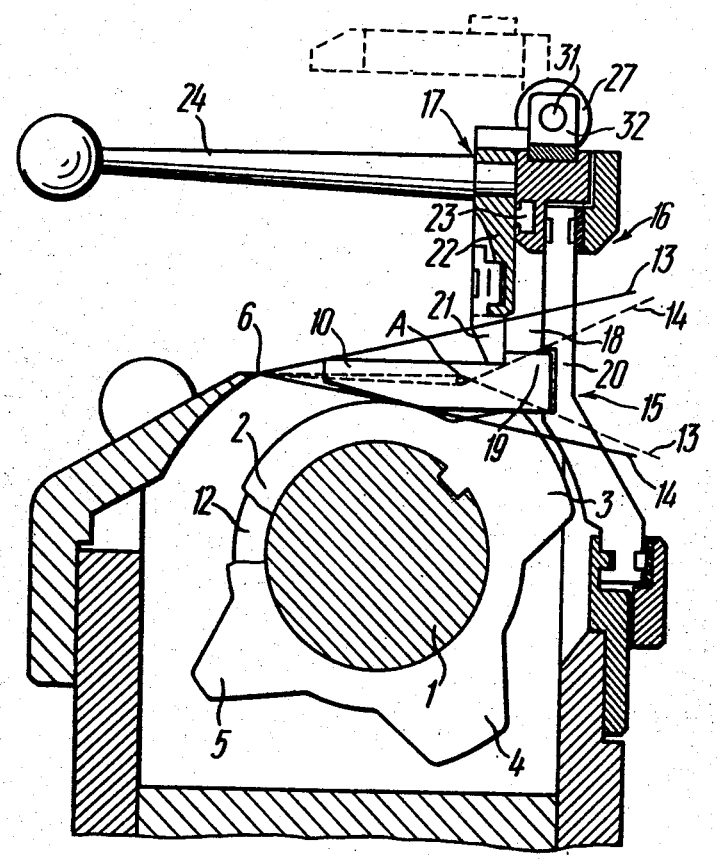
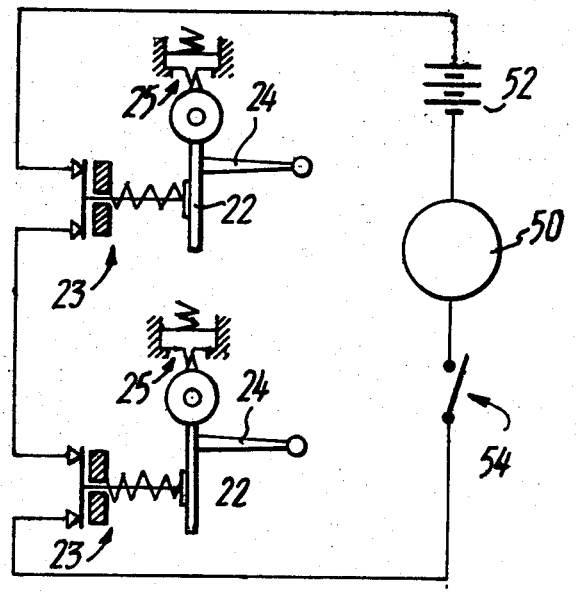
FIG. 5

TRAVELLING-WAVE LOOM WITH LOOM-STOPPING MECHANISM

The present invention relates to travelling-wave looms.

At present, there is known a mechanism which comprises a rotary reed and a separating grate disposed between two apparatus for propelling the weft thread carriers.

The rotary reed is formed by disks each being provided with teeth of different length adapted to beat up the weft thread and to propel the weft thread carriers through the shed of the warp threads. The teeth are arranged so that their radial length increases in the direction of the weft thread beating-up.

The separating grate is made up of a pivoted and a stationary portions swivelled to each other and forming, while the pivoted portion is in the operating position, a channel for the weft thread carriers to be partially disposed therein. Each of the portions of the separating grate is formed by plates installed with a gap relative to one another for the warp threads to pass therethrough. The pivoted portion of the grate, which is parallel to and urged against the stationary portion thereof, is held in the operating position by springs exerting thereon a pressure required for ensuring normal movement of the weft thread carriers through the shed.

Upon having encountered an obstacle in the shed (for instance, the trailing-ins, i.e. the weft threads intertwined with the warp threads outside the fell of the cloth) the weft thread carriers, being acted upon by the teeth of the reed disk, exert pressure on the plates of the pivoted portion exceeding somewhat the effort applied by the springs, thereby causing the pivoted portion of the grate to turn. In this way, the weft thread carriers are relieved of the action of the pivoted portion of the grate.

However, the direct swivel coupling of the plates of the pivoted portion with the stationary one involves certain inconveniences resides mainly in the fact that, while being disengaged from the obstacle, the weft thread carrier manages to pass along a considerable portion of the channel formed by the separating grate under the action of the teeth of the rotary reed disk. Thus, the weft thread carrier may eventually bump against the unturned plates of the pivoted portion of the separating grate, which may break the plates and damage the disk teeth.

Besides, this cloth-forming mechanism is not provided with devices enabling, upon the pivoted portion of the grate having turned, to actuate the stop motion of the loom for the latter to be stopped.

It is an object of the present invention to provide a mechanism of a travelling-wave loom with a separating grate of a construction which will make it possible, upon an obstacle having been encountered in the shed, to preclude any contact of the weft thread carriers with the plates of the unturned portion of the separating grate and to rapidly being the loom to a stop.

This object is attained in a mechanism for a travelling-wave loom, comprising, between two apparatus for propelling the weft thread carriers, a rotary reed with disks having teeth for beating up the weft thread and for propelling the weft thread carriers, and a separating grate made up of a pivoted and stationary portions forming, in the operating position, a channel for the weft thread carriers to be partially disposed therein, each of the portions being formed by plates installed with a gap relative to one another for the warp threads to pass therethrough, in which mechanism, according to the invention, the pivoted portion of the separating grate is provided with a plurality of strips arranged in line along the entire length of the grate, each of which strips is swivelled to the stationary portion of the grate and the plates of the pivoted portion, which are in contact with the weft thread carriers, are attached to each of the strips, with generally known devices accomplishing the coupling with the loom stop motion being installed near the strips they cooperate with.

Due to the coupling of the pivoted and stationary portions of the separating grate by means of strips and due to the attachment of the plates of the pivoted portion thereto, it is possible to arrange the plates of this portion in sections. As soon as an obstacle is encountered in the shed, the weft thread carriers, while acting upon the plates, cause the whole of the section of the grate pivoted portion to turn. Since the devices accomplishing the coupling with the loom stop motion are installed near the strips, the turning of a strip causes these devices to actuate the stop motion, thereby bringing the loom to a stop, the weft thread carriers being stopped so fast that they fall short of the next section of the pivoted portion of the grate, which is in the operating position. In this way, the carriers are prevented from bumping into the plates of the pivoted portion.

According to an alternative embodiment of the invention, the devices accomplishing the coupling with the loom stop motion are installed on the stationary portion of the separating grate and are in contact with the strips when the pivoted portion is in the operating position.

Besides, in accordance with the present invention, each strip is provided with a handle to be turned manually and with a retainer holding the pivoted portion in the turned (inoperative) and operating positions. This makes the servicing of the loom more convenient.

It is preferable to have the retainer composed of two geared and tightened together parts, one of the parts being mounted on the strip and the other one, on a non-turnable shaft, with the gearing and tightening force being selected such that it balances the force applied to the pivoted portion by the weft thread carrier during normal movement thereof through the shed.

Thus, the proposed mechanism is convenient in servicing the loom as well as in changing the carriers in the shed and arranging the warp threads between the plates of the separating grate which, in the last analysis, increases the efficiency of the loom and cuts down the time lost on the reeding. In addition, with this mechanism, the probability of causing damage to the plates of the separating grate is minimized and the reliability of operation of the loom is ensured.

Given below is a detailed description of the present invention with reference to the accompanying drawings, wherein:

FIG. 1 is a cross-sectional view of a mechanism for a travelling-wave loom, according to the invention;

FIG. 2 schematically illustrates the operation;

FIG. 5 is a schematic wiring diagram.

Figure 2:
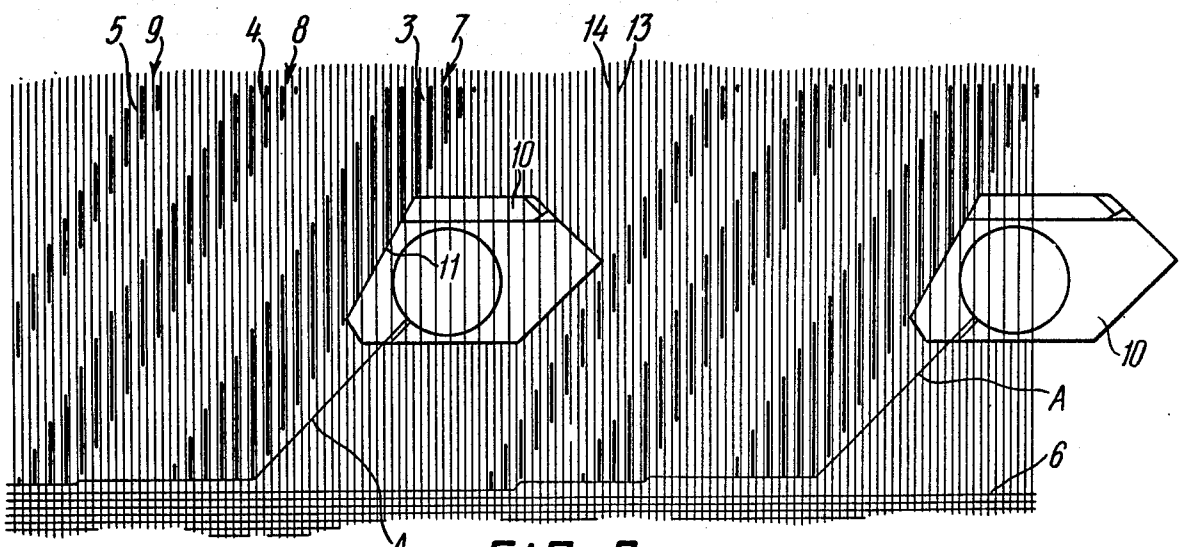

Referring now to the drawings, the illustrated mechanism (FIG. 1) of a travelling-wave loom is disposed between two apparatus for propelling the weft thread carriers (not shown in the FIG. 1) and comprises a rotary reed and a separating grate.

The rotary reed is formed by a shaft 1 and disks 2 secured on the shaft 1. Each of the disks 2 is provided with teeth 3, 4, 5 advancing and forcing a weft thread A (FIG. 2) to a fell 6 of the cloth and having different radial lengths, as is shown in FIG. 1.

The radial length of the teeth 3, 4, 5 increases in the direction of the beating-up of the weft thread A.

The disks 2 are angularly offset on the shaft 1 relative to one another so that the teeth 3 (FIG. 2) thereof extend along a helicoid 7, the teeth 4 along a helicoid 8, and the teeth 5 along a helicoid 9.

The tooth 3 (FIG. 1) of each of the disks 2 is the shortest one and serves as a means for propelling a carrier 10 (FIG. 2) of the weft thread A, while interacting with a butt end 11 thereof.

Inserted between the disks 2 (FIG. 1) are rings 12 providing gaps between these disks for warp threads 13 and 14 forming a shed 15.

A separating grate is provided for separating and distributing uniformly the warp threads 13 and 14 among the disks 2 of the reed when the shed 15 is being formed, as well as for guiding the weft thread carriers 10 during their travel through the shed.

The separating grate is made up of a stationary portion 16 and a provided portion 17 which is installed parallel to the stationary portion 16, the portion 17 being shown in its operating one. The provided portion 17, while in the operating position, form together with the stationary portion 16 a channel 18 wherein an abutment 19 of the weft thread carrier 10 is partially accommodated and guided.

Each of the portions 16 and 17 is formed by plates 20 and 21, respectively.

The plates 20 and 21 of the portions 16 and 17 are installed opposite one another, a gap being maintained between the plates 20 and the plates 21, the size of which corresponds to that of the gap between the disks 2.

The plates 20 and 21 of the separating grate are installed opposite the disks 2.

The provided portion 17 of the grate is provided with a plurality of strips 22 (FIG. 3) arranged in line along the entire length of the grate.

Each of the strips 22 (FIG. 1) is swivelled to the stationary portion 16, and attached to each strip 22 from below are the plates 21 of the provided portion 17, which are in contact with the carriers 10 of the weft thread.

Installed near the strips 22 are devices cooperating with these strips and providing for coupling with the stop motion of the loom (not shown). Used as these coupling devices may be any known devices suitable for the purpose, for instance, microswitches 23 inserted into the electric control circuit of the loom stop motion.

The microswitches 23 are installed on the stationary portion 16 of the separating grate and are in contact with the strips 22 when the portion 17 is in the operating position, with the loom running.

Each strip 22 is provided with a handle 24 for turning the portion 17 manually and with a retainer 25 (FIG. 3) for holding the portion 17 in a turned or in operative position and in its operating position.

The retainer 25 is composed of two parts 26 and 27 geared together. The part 26 has a projection 28 and the part 27 has a recess 29. The parts 26 and 27 are pressed together by a spring 30, the gearing and tightening force applied to the parts 26 and 27 being selected such that it balances the force exerted by the carriers 10 of the weft thread on the rotatory portion 17 during their normal movement through the shed.

The part 27 of the retainer 25 is mounted on an shaft 31 set rotatably in a support 32 of the stationary portion 16 of the grate.

Figure 3:
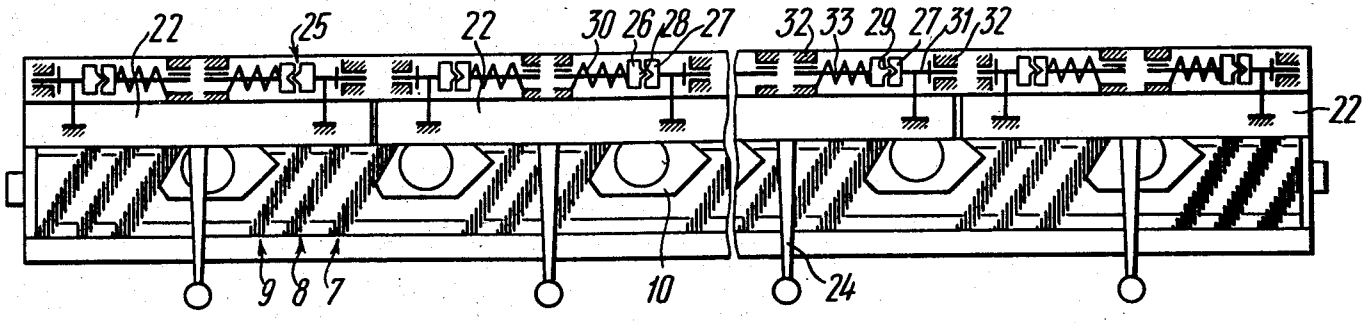
FIG. 3 is a top view to a reduced scale of the mechanism of FIG. 1.
Figure 4:
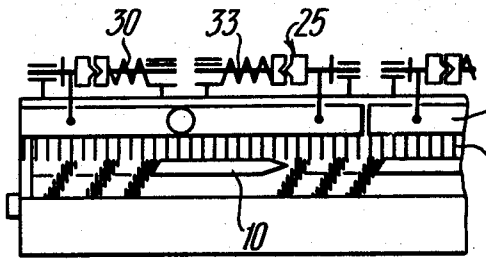
FIG. 4 is a front view of a part of the mechanism.

The part 26 is mounted on a non-rotatable but axially movable shaft 33 secured in the support 32 of the portion 16 of the grate, the shaft 33 carrying the spring 30 as is shown in FIGS. 3 and 4.

Such an attachment of the retainer parts ensures a swivel coupling of the portions 16 and 17 of the grate (FIG. 1) as well.

Referring to FIG. 5, there is schematically illustrated therein a pair of the series-connected, normally-open switches 23. Although only two of these switches are shown in FIG. 5 it will be understood that any number of these switches can be connected in series in the manner illustrated. The series circuit includes the driving motor 50 for the loom, as well as a source of energy 52 and a starting and stopping switch 54.

The strips 22 are shown in FIG. 5 holding the switches 23 in their closed positions while the retainers 25 are schematically illustrated. As is apparent from FIG. 5 when any one of the strips 22 is turned in a counterclockwise direction, it will be held by the retainer 25 in a position which will enable the switch 23 to remain in its open position, thus automatically stopping the operation of the loom.

The herein disclosed mechanism operates as follows.

With the shaft 1 rotating, the teeth 3 of the disks 2 thereof, while cooperating with the butt end 11 of the weft thread carriers 10, propel the latter through the shed of the warp threads as is shown in FIGS. 1, 3, 4. Since each carrier 10 is partially accommodated in the channel 18 of the separating grate, the carriers 10 during their travel are in constant contact with the plates 21 of the pivot portion 17 of the separating grate.

The weft threads A emerging from the carriers 10 (FIG. 2) are engaged by the teeth 3 and 4, advanced to the fell 6 of the cloth, forced thereto by the teeth 5 and woven into the cloth as the shed 15 operates.

If in the shed 15 (FIG. 1) of the warp threads an obstacle is encountered by the carriers 10, for instance, a trailing-in part of weft A, the shed 15 becomes noticeably smaller since the threads 13 and 14 are intertwined next to the fell of the cloth as is shown by broken lines in FIG. 1. When in such a shed, the carrier 10 tends to spread apart the warp threads of the shed 15 to cause them to tend to assume the initial shape.

Thus, the carrier 10 exerts a certain force on the threads 13 and 14 and, should the obstacle be sufficiently resistant, the ever growing force applied by the teeth 3 of the rotary reed is transmitted to the carrier, and the latter starts acting upon the plates 21 of the pivoted portion 17 with a greater force. This force overcomes the gearing and tightening force of the parts 26 and 27 (FIG. 3) of the retainer 25. The portion 17 of the grate turns causing the part 27 of the retainer 25 to turn relative to the part 26 to thereby fix the pivoted portion 17 in the raised position as shown in FIG. 1 by phantom lines. As a result, the carrier 10 of the weft thread is relieved of the action of the plates 21 and the breakage of the entangled shed warp threads is avoided.

At the moment when the rotatory portion 17 (FIG. 1) turns, the strips 22 depart from the microswitches 23, the latter act upon the electric control circuit of the drive, the stop motion operates and the loom stops.

Upon eliminating the cause of turning of the portion 17 the carrier 10 is set in the shed 15 of the warp threads, the pivoted portion 17 is returned to the initial operating position by manipulating the handle 24, the contact of the strip 22 of the portion 17 with the microswitch 23 is restored and the loom is restarted.

Should the need arise to change one of the carriers 10, the associated portion 17 of the separating grate is turned up by means of the handle 24, and after the weft thread carrier is replaced, the portion is returned into the operating position.

Since the separating grate has a plurality of strips 22, it is evident that the number of the pivoted portions 17 of the grate corresponds to that of the strips 22 and, therefore, when one of the portions of the grate is turned, the rest of the rotatory portions 17 thereof remain in the initial position.

What is claimed is:

1. In a travelling-wave loom, a rotary reed including a rotary shaft carrying disks each of which are provided with teeth for advancing a weft carrier and for beating up the weft, guide means extending parallel to said rotary reed for guiding a weft carrier advanced by teeth of said disks of said rotary reed, said guide means including a stationary portion and a pivoted portion pivoted to said stationary portion and defining with said stationary portion a channel for receiving part of a weft carrier to guide the latter, said pivoted portion including a plurality of strips situated in line with each other along the path of travel of a weft carrier and said strips each being individually turnable with the pivoted portion of said guide means, releasable holding means operatively connected with the pivoted portion of said guide means for releasably holding the pivoted portion thereof together with said strips in an operative position defining with said stationary portion of said guide means said channel for guiding the weft carriers, said releasable holding means holding said pivoted portion in its operative position with a force which is small enough to permit any one strip and the part of the pivoted portion connected thereto to turn in opposition to the force of said releasable holding means away from its operative position when a weft carrier encounters an obstruction during travel of the weft carrier, and means engaging said strips when the pivoted portion of said guide means is in its operative position for responding to turning of any one of said strips away from its operative position to stop the operation of the loom, said stationary portion of said guide means including a plurality of plates respectively aligned with said disks of said rotary reed and defining between themselves spaces for guiding warp yarns of a shed, and said pivoted portion of said guide means also including a plurality of plates, the latter plates respectively being in line with said disks of said rotary reed and in line with said plates of said stationary portion of said guide means for also defining between themselves spaces for accommodating warp yarns of a shed, said plates of said pivoted portion forming groups of plates which are respectively fixed to said strips and which extend therefrom to define with said plates of said stationary portion said channel for receiving part of a weft carrier to guide the latter, whereby when any one strip turns in opposition to the force of said releasable holding means away from its operative position when a weft carrier encounters an obstruction during travel of the weft carrier, the plates which are fixed to said one strip also turn therewith, said releasable holding means cooperating with the pivoted portion of said guide means for releasably holding a strip and the part of said pivoted portion of said guide means connected thereto in its inoperative position when it has turned toward the latter position in response to obstruction of a weft carrier, so as to indicate visually the location of an obstruction encountered by a weft carrier.

2. The combination of claim 1 and wherein said means for responding to turning of any one strip away from its operative position to stop the operation of the loom is carried by the stationary portion of said guide means.

3. The combination of claim 2 and wherein said means for responding to turning of any one strip away from its operative position is in the form of a switch.

4. The combination of claim 1 and wherein a handle is operatively connected with each strip for turning the latter between its operative and inoperative positions.

5. The combination of claim 1 and wherein said releasable holding means includes a pair of geared components one of which is pressed with a given force toward the other, one of said geared components being operatively connected with the turnable portion of said guide means to turn therewith.

* * * * *